United States Patent [19]

Hirata et al.

[11] Patent Number: 4,607,967

[45] Date of Patent: Aug. 26, 1986

[54] PRINTING APPARATUS

[75] Inventors: Yoshikatsu Hirata; Shigeo Ishikawa, both of Nagoya, Japan

[73] Assignee: Brother Kogyo Kabushiki Kaisha, Aichi, Japan

[21] Appl. No.: 694,815

[22] Filed: Jan. 25, 1985

[30] Foreign Application Priority Data

Jan. 31, 1984 [JP] Japan ..... 59-12922[U]

[51] Int. Cl.[4] ..... B41J 1/56; B41J 1/60

[52] U.S. Cl. ..... 400/175; 400/320; 400/124; 400/55; 400/352

[58] Field of Search ..... 400/118, 57, 59, 124, 400/174, 175, 139, 320, 283, 352, 56, 55; 269/89, 104, 152, 257, 258, 262

[56] References Cited

U.S. PATENT DOCUMENTS 90,783 6/1869 Riggs ..... 269/258
2,722,867 11/1955 Dackos et al. ..... 269/267 X

FOREIGN PATENT DOCUMENTS 123488 9/1980 Japan ..... 400/320
60285 5/1981 Japan ..... 400/320

OTHER PUBLICATIONS

IBM Tech. Disc. Bulletin, "Self-Adjusting Damper Assembly", Rosenberg, vol. 26, No. 6, Nov. 1983, p. 2941.

*Primary Examiner*—Edgar S. Burr
*Assistant Examiner*—James R. McDaniel
*Attorney, Agent, or Firm*—Parkhurst & Oliff

[57] ABSTRACT

A printing apparatus having a platen for supporting a sheet of paper, comprising: a carriage movable along the length of the platen, and including an upward protrusion having a top surface which includes a first slant part inclined downwardly in a direction toward the platen; a print head including a mounting portion resting on the upward protrusion, the mounting portion having a bottom surface which includes a second slant part in abutting contact with the first slant part; and a fixing device for clamping the mounting portion of the print head to the upward projection of the carriage substantially in a direction of height of the upward protrusion. An angle of inclination of the first and second slant parts being selected such that a clamping action of the fixing device produces a component force sufficient to force a portion of the print head against a side surface of the protrusion on its side opposite to the side facing the platen.

8 Claims, 4 Drawing Figures

PRINTING APPARATUS

BACKGROUND OF THE INVENTION

The present invention relates generally to a printing apparatus wherein a print head is mounted on a carriage.

In a commonly known printing apparatus of this type as shown in FIG. 1, a carriage 1 is movable along the length of a platen 3, guided by a guide rod 2 and driven by a motor via a timing belt, or wire (not shown). The carriage 1 includes an upward protrusion 4. A print head 5 has a mounting portion 6 resting on the upward protrusion 4. The mounting portion 6 has a through-hole 6*a* which is drilled downwardly from its top surface. The upward protrusion 4 has a tapped hole 4*a* which is tapped downwardly from its top surface. The print head 5 is mounted to the carriage 1 by a screw member 7 which is inserted through the through-hole 6*a* and threaded into the tapped hole 4*a*.

Upon mounting the print head 5 in the printing apparatus constructed as described above, the operator grips the print head 5 and places it on the upward protrusion 4 of the carriage 1. At this time, the upward protrusion 4 and mounting portion 6 are clamped by the screw member 7, with the print head 5 pushed in a direction toward the platen 3, so that a front surface 6*b* of the mounting portion 6 is brought into close contact with a rear surface 4*b* of the upward protrusion 4, whereby the print head 5 is positioned on the carriage 1. However, the above-described arrangement requires much time and labor for mounting the print head 1, resulting in comparatively low operating efficiency of the printing apparatus.

SUMMARY OF THE INVENTION

It is therefore an object of the present invention to provide a printing apparatus which allows easy mounting of a print head on a carriage, and easy and accurate positioning of the print head relative to the carriage.

According to the present invention, there is provided a printing apparatus having a platen for supporting a sheet of paper. The printing apparatus comprises a carriage movable along the length of the platen, and including an upward protrusion having a top surface which includes a first slant part inclined downwardly in a direction toward the platen, and a print head including a mounting portion resting on the upward protrusion. The mounting portion has a bottom surface which includes a second slant part in abutting contact with the first slant part. The printing apparatus further comprises fixing means for clamping the mounting portion of the print head to the upward protrusion of the carriage substantially in a direction of height of the upward protrusion, and an angle of inclination of the first and second slant parts being selected such that a clamping action of the fixing means produces a component force sufficient to force a portion of the print head against a side surface of the protrusion on its side opposite to the side facing the platen.

In the present invention constructed as described above, the top surface of the upward protrusion of the carriage is provided with the first slant part which is inclined downwardly in the direction toward the platen, and the bottom surface of the mounting portion of the print head is furnished with the second slant part in abutting contact with the first slant part so that the print head is brought into pressed contact with the rear side surface of the upward protrusion of the carriage by clamping the mounting portion to the upward protrusion with the fixing means. Therefore, when the print head is mounted on the carriage, the print head is automatically positioned accurately and easily. Consequently, the print head can be changed without troublesome positioning efforts, resulting in enhanced assembling efficiency.

When dot-matrix print wires strike the platen, a reaction force is received by the first slant part of the upward protrusion. Therefore, as compared to the prior art construction shown in FIG. 1 wherein the top surface of the upward protrusion is horizontal, the construction according to the invention assures less possibility that the reaction force of the print wire upon its impact on the platen will affect the position of the print head with respect to the carriage.

It is another object of the invention to provide a printing apparatus which has the simplest possible arrangements for clamping the print head to the carriage. To achieve this object, the fixing means comprises a screw member which extends through a through-hole formed through the mounting portion of the print head in the direction of height, and which is threaded in a tapped hole formed in the upward protrusion.

It is another object of the invention to provide a printing apparatus which does not permit the clamping screw member to be separated from the print head when the print head is dismounted from the carriage. To achieve this object, the screw member has a stem portion and an externally threaded portion at one end of the stem portion, and the externally threaded portion is larger in diameter than the stem portion. The through-hole has an internally threaded portion engageable with the externally threaded portion of the screw member, and the through-hole and/or the tapped hole is counterbored at an end thereof on the side of abutting contact of the upward protrusion and the mounting portion to define a cylindrical chamber concentric with the through-hole and the tapped hole. The cylindrical chamber has a diameter larger than a major diameter of the externally threaded portion of the screw member and a length greater than a length of the externally threaded portion.

It is another object of the invention to provide a printing apparatus having a wire dot-matrix print head which is easily and accurately positioning to the carriage. To attain this object, the print head comprises a nose for guiding print wires toward and away from the platen in a direction substantially parallel to the length of the nose, and a wire drive for moving the print wires. The mounting portion of the print head comprises a pair of flanges protruding from opposite sides of the nose in opposite directions perpendicular to the length of the nose, and each of the flanges has a through-hole for a mounting screw.

It is still another object of the invention to provide a printing apparatus which permits an easy access to the screw member when the wire dot-matrix print head is mounted or dismounted on or from the carriage. To achieve this object, the screw member has a head engageable with a tool for driving the screw member, and a flange portion disposed at a predetermined distance from the head axially of the screw member. The flange portion is seated on an upper surface of each flange of the mounting portion, and the head is located above an upper surface of the nose of the print head.

It is a further object of the invention to provide a printing apparatus which allows the print head to be stably supported by the carriage and positioned at a substantially accurate position prior to the clamping of the fixing means. To achieve this object, the carriage further includes a boss spaced from the upward protrusion away from the platen to temporarily support the print head at its bottom during the clamping of the mounting portion of the print head to the upward protrusion, and the bottom of the print head is held in slightly spaced-apart relation with a top surface of the boss after the mounting portion of the print head has been clamped in position to the upward protrusion by the fixing means with the first and second slant parts in abutting contact with each other.

BRIEF DESCRIPTION OF THE DRAWING

The foregoing and additional objects, features and advantages of the present invention will be better understood from reading the following detailed description of the preferred embodiment taken in connection with the accompanying drawing in which.

DETAILED DESCRIPTION OF THE PREFERRED EMBODIMENTS

Figure 2:
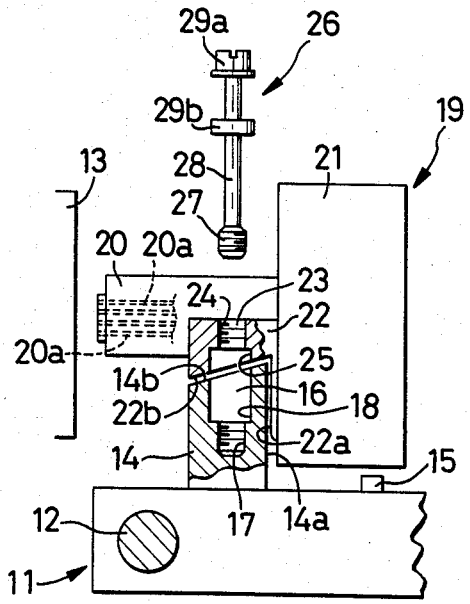
FIG. 2 is a view similar to FIG. 1, showing an embodiment of the present invention.
Figure 3:
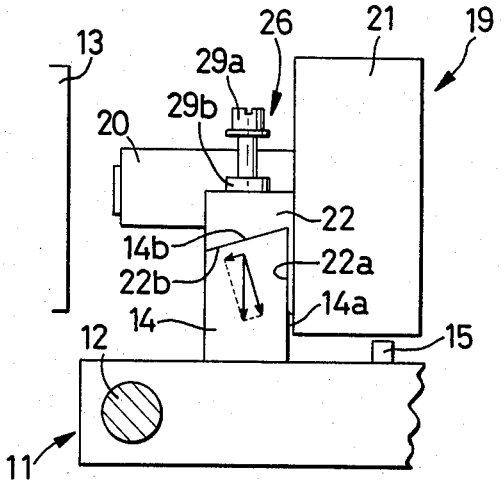
FIG. 3 is a fragmentary side view of the printing apparatus of the invention, illustrating the print head mounted to the carriage.

Referring now to the accompanying drawings, there is shown in FIGS. 2–3 a printing apparatus equipped with a wire dot-matrix print head in one preferred form of the invention.

As shown in FIG. 2, a carriage 11 slidably supported a guide rod 12 is movable along the length of a platen 13 for supporting a sheet of paper P, and includes an upward protrusion 14. At the back of the upward protrusion 14 is provided a boss 15 which is slightly spaced from the bottom of a wire drive 21 of a print head 19 which will be described.

The upward protrusion 14 has a rear side surface 14*a* which is a flat surface extending in a substantially vertical direction. The print head 19 has a front side surface 22*a* which is a flat surface abutting on the rear side surface 14*a* of the upward protrusion 14. On the top of the upward protrusion 14 is formed a first slant surface 14*b* inclined approximately 20° downwardly in a direction toward the platen 13. The upward protrusion 14 has a hole 16 formed downwardly from the first slant surface 14*b*. The hole 16 consists of a lower tapped hole 17, and an upper counterbore 18 which is larger in diameter than the tapped hole 17.

The print head 19 comprises a nose 20 for guiding print wires 20*a* toward and away from the platen 13 in a direction substantially parallel to the length of the nose 20, the previously indicated wire drive 21 for moving the print wires 20*a*, and a mounting portion 22 resting on the upward protrusion 14. The mounting portion 22 has a through-hole 23 downwardly from its top surface toward the upward protrusion 14. The upper part of the through-hole 23 has a tapped hole 24 which has the same diameter as the tapped hole 17. The lower part of the through-hole 23 is a counterbore 25 which has the same diameter as the counterbore 18 formed in the upward protrusion 14. The counterbores 18 and 25 cooperate to define a cylindrical chamber 18, 25. The front side surface 22*a* at a lower portion of the mounting portion 22 extends in a vertical direction and is kept in pressed contact with the rear side surface 14*a* of the upward protrusion 14. On the bottom of the mounting portion 22 is formed a second slant surface 22*b* which is held in abutting contact with the first slant surface 14*b* of the upward protrusion 14.

A screw member 26 acting as fixing means for clamping the mounting portion 22 to the upward protrusion 14 has a stem portion 28, an externally threaded portion 27 at one end of the stem portion 28, a head 29*a* engageable with a tool for driving the screw member 26, and a flange portion 29*b* disposed at a predetermined distance from the head 29*a* axially of the screw member 26. The externally threaded portion 27 of the screw member 26 is engageable with the tapped holes 17 and 24. The flange portion 29 is seated on the upper surface of the mounting portion 22, and the head is located above the upper surface of the nose 20 of the print head 19.

The above described mounting portion 22 formed is provided in the form of a pair of flanges 22, 22 protruding from both sides of the nose 20 in opposite directions perpendicular to the length of the nose 20. The upward protrusion 14 is provided at two positions on the carriage 11 so that each flange 22 rests on the corresponding upward protrusion 14. Thus, the print head 19 is mounted on the carriage 11 with the two screw members 26 which clamp the pair of flanges 22, 22 to the respective upward protrusions 14.

In the printing apparatus constructed as mentioned above, the print head 19 is secured to the carriage 11 in the manner described hereunder.

First, the externally threaded portion 27 of the screw member 26 is threaded into the tapped hole 24 in the mounting portion 22. The externally threaded portion 27 then comes out of the tapped hole 24, and the screw member 26 is held by the mounting portion 22 of the print head 19, with the flange portion 29*b* in contact with the top surface of the mounting portion 22. In this condition, the tapped hole 24 serves to prevent the screw member 26 from being removed upwardly from the mounting portion 22. Then, the print head 19 is positioned relative to the upward protrusion 14 of the carriage 11 so that the screw member 26 fits into the hole 16 and so that the wire drive 21 is put on the boss 15. In this condition, the print head 19 is supported by the upward protrusion 14 and the boss 15. Namely, the rear end portion of the second slant surface 22*b* is in contact with that of the first slant surface 14*b*, but the other portions of the first and second slant surfaces 14*b*, 22*b* are not in contact with each other.

When the externally threaded portion 27 is then screwed into the tapped hole 17, the flange portion 29*b* is pressed against the mounting portion 22, and the second slant surface 22*b* comes into pressed contact with the first slant surface 14*b* of the upward protrusion 14. As a result, as shown in FIG. 3, since a force is applied to the print head 19 in a direction along the first slant surface 14*b* of the upward protrusion 14, the print head 19 is biased forward (leftward in FIG. 3). Accordingly, when there is a clearance between the front side surface 22*a* of the mounting portion 22 and the rear side surface 14*a* of the upward protrusion 14, the print head 19 moves forward until the front side surface 22*a* comes into pressed contact with the rear side surface 14*a*.

When the print head 19 comes to a stop, it is securely mounted and accurately positioned at the predetermined position on the carriage 11. In this state, the wire drive 21 is slightly lifted upward from the engagement portion 15.

Explained hereunder is a method of dismounting the print head 19 from the carriage 11.

Since the head 29*a* of the screw member 26 is located above the nose 20, the screw member 26 can be easily loosened. When the externally threaded portion 27 of the screw member 26 leaves the tapped hole 17 in the upward protrusion 14, the print head 19 can be removed from the carriage 11.

Figure 1:
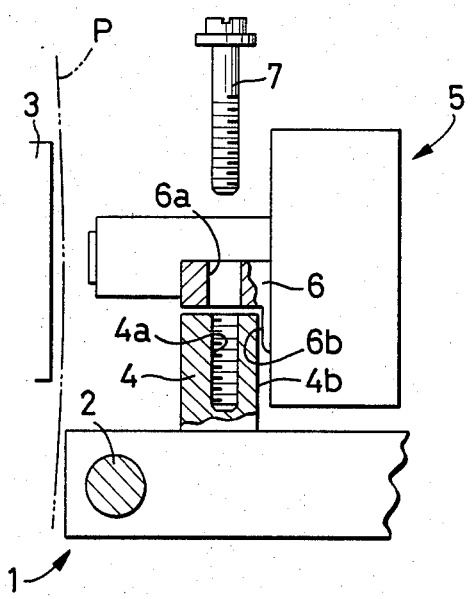
FIG. 1 PRIOR ART
FIG. 1 is a fragmentary side view of the printing apparatus of the prior art, partially in cross section.
Figure 4:
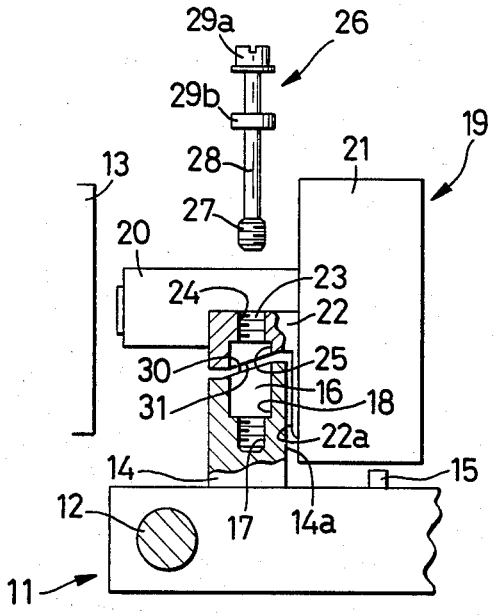
FIG. 4 is a view similar to FIG. 1 showing another embodiment of the present invention.

Referring now to FIG. 4, another embodiment of the invention will be described.

In the preceding embodiment, the first and second slant surfaces 14*b*, 22*b* extend over the entire portions of the top surface of the upward protrusion 14 and the bottom surface of the mounting portion 22. In this embodiment, however, a first slant part 30 inclined downwardly in a direction toward the platen 13 is provided on a portion of the top surface 14 of the upward protrusion 14, and a second slant part 31 is provided partially in the bottom surface of the mounting portion 22 so that the second slant part 31 is in abutting contact with the first slant part 30 on the top surface of the upward protrusion 14. The angle of inclination of these slant parts 30, 31 are determined depending on the area of the slant parts, i.e., the angle of inclination is increased as the area is reduced.

In each of the above described two embodiments, the first slant part 14*b* or 30 inclined downwardly in a direction toward the platen 13 is provided on the top surface of the upward protrusion 14, and the second slant part 22*b* or 31 is provided on the bottom surface of the mounting portion 22 so that the second slant part 22*b* or 31 is held in abutting contact with the first slant part 14*b* or 30. When the screw member 26 is tightened, the print head 19 is brought into pressed contact with the rear side surface 14*a* of the upward protrusion 14, whereby the print head 19 can be mounted on the carriage 11 in a short time without troublesome positioning efforts. Also, since the rear side surface 14*a* of the upward protrusion 14 extends in a substantially vertical direction, the print head 19 is not moved upwardly when it comes into pressed contact with the rear side surface 14*a*, and therefore, the print head 19 is accurately held at the predetermined position of the carriage 11. Moreover, the screw member 26 can be easily threaded into or removed from the tapped hole 17 in the upward protrusion 14 because the hole 16 and the through-hole 23 include the large diameter counterbores 18 and 25. Further, the screw member 26 can also be easily threaded or removed, because it is provided with the flange portion 29*b*, and the head 29*a* thereof is located above the nose 20.

What is claimed is:

1. A printing apparatus having a platen for supporting a sheet of paper, comprising:

a carriage movable along the length of said platen, and including an upward protrusion having a top surface which includes a first slant part inclined downwardly in a direction toward said platen, and a side surface on the side of said upward protrusion remote from said platen;

a print head including a mounting portion resting on said upward protrusion, said mounting portion having a bottom surface which includes a second slant part in abutting contact with said first slant part, said second slant part terminating in a downwardly extending projection at the end remote from said platen; and fixing means for clamping said mounting portion of said print head to said upward protrusion of said carriage substantially in the direction of height of said upward protrusion and with said slant parts engaged with each other, the angle of inclination of said first and second slant parts when combined with clamping action of said fixing means producing a component of force sufficient to force said downwardly extending projection of said print head against said side surface of said protrusion.

2. A printing apparatus as set forth in claim 1, wherein said fixing means comprises a screw member which extends through a through-hole formed through said mounting portion of the print head in said direction of height, and which is threaded in a tapped hole formed in said upward protrusion.

3. A printing apparatus as set forth in claim 2, wherein said screw member has a stem portion and an externally threaded portion at one end of said stem portion, said externally threaded portion being larger in diameter than said stem portion, said through-hole having an internally threaded portion engageable with said externally threaded portion of said screw member, said through-hole and/or said tapped hole being counterbored at an end thereof on the side of abutting contact of said upward protrusion and said mounting portion to define a cylindrical chamber concentric with said through-hole and said tapped hole, said cylindrical chamber having a diameter larger than a major diameter of said externally threaded portion of said screw member and a length greater than a length of said externally threaded portion.

4. A printing apparatus as set forth in claim 1, wherein said side surface of said upward protrusion is a flat surface extending in a vertical direction, said portion of the print head having a flat surface abutting on said flat surface of said upward protrusion.

5. A printing apparatus as set forth in claim 1, wherein said frist slant part covers an entire portion of said top surface of said upward protrusion.

6. A printing apparatus as set forth in claim 2, wherein said print head is a wire dot-matrix print head comprising a nose for guiding print wires toward and away from said platen in a direction substantially parallel to the length of the nose, and a wire drive for moving said print wires, said mounting portion of the print head comprising a pair of flanges protruding from opposite sides of said nose in opposite directions perpendicular to said length of the nose, each of said flanges having said through-hole.

7. A printing apparatus as set forth in claim 6, wherein said screw member has a head engageable with a tool for driving the screw member, and a flange portion disposed at a predetermined distance from said head axially of the screw member, said flange portion being seated on an upper surface of said each flange of the mounting portion, and said head being located above an upper surface of said nose of the print head.

8. A printing apparatus as set forth in claim 1, wherein said carriage further includes a boss spaced from said upward protrusion away from said platen to temporarily support said print head at its bottom during the clamping of said mounting portion of the print head to said upward protrusion, said bottom of the print head being held in slightly spaced-apart relation with a top surface of said boss after said mounting portion of the print head has been clamped in position to said upward protrusion by said fixing means with said first and second slant parts in abutting contact with each other.

* * * * *